US006942608B2

(12) United States Patent
Linton et al.

(10) Patent No.: US 6,942,608 B2
(45) Date of Patent: Sep. 13, 2005

(54) RECLOSABLE BAG HAVING WICKET FLAP AND SLIDER-ACTUATED STRING ZIPPER

(75) Inventors: Basil C. Linton, Loganville, GA (US); Gregory H. Crunkleton, Nicolson, GA (US)

(73) Assignee: Illinois Tool Works Inc., Glenview, IL (US)

( * ) Notice: Subject to any disclaimer, the term of this patent is extended or adjusted under 35 U.S.C. 154(b) by 78 days.

(21) Appl. No.: 10/602,783

(22) Filed: Jun. 24, 2003

(65) Prior Publication Data

US 2004/0161170 A1 Aug. 19, 2004

Related U.S. Application Data

(63) Continuation-in-part of application No. 10/367,450, filed on Feb. 14, 2003.

(51) Int. Cl.[7] ..... B31B 1/90
(52) U.S. Cl. ..... 493/212; 493/213
(58) Field of Search ..... 493/212–214; 53/133.4, 139.2

(56) References Cited

U.S. PATENT DOCUMENTS 5,641,318 A * 6/1997 Vetter ..... 493/189
5,682,730 A 11/1997 Dobreski ..... 53/469
5,983,594 A * 11/1999 Forman ..... 53/133.5
6,167,597 B1 * 1/2001 Malin ..... 24/585.1
6,517,473 B1 * 2/2003 Cappel ..... 493/213
6,517,660 B2 * 2/2003 Ausnit ..... 156/270
6,609,998 B2 * 8/2003 Lauzon et al. ..... 493/194
6,780,146 B2 * 8/2004 Thomas et al. ..... 493/213
6,804,935 B2 * 10/2004 Schneider et al. ..... 53/412

* cited by examiner

*Primary Examiner*—Eugene Kim
(74) *Attorney, Agent, or Firm*—Ostrager Chong Flaherty & Broitman P.C.

(57) ABSTRACT

A reclosable bag having a bottom flap with holes configured to allow a stack of the bags to be mounted on a wicket, a slider-actuated string zipper installed in a mouth at the top of the bag, and a band seal at the bottom of the bag. The bottom of the bag is closed. The wicket flap has a line of weakened tear resistance, such as a perforated line, along which the bag can be torn. The bag on top of the stack can be filled through the open zipper with product. After filling, the zipper is closed by operating the slider and then the filled bag is separated from its flap, which remains on the wicket, by tearing along the tear line.

15 Claims, 5 Drawing Sheets

FIG.5
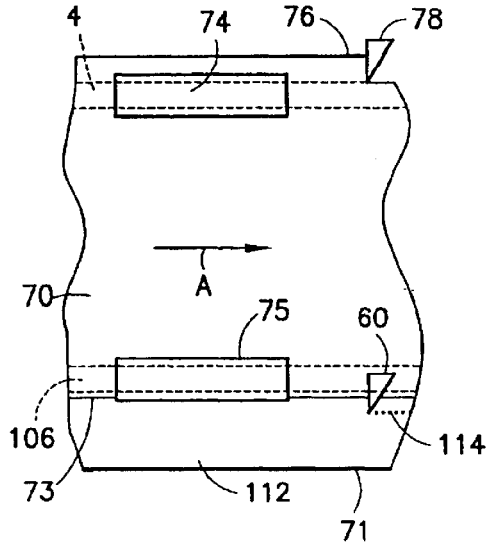
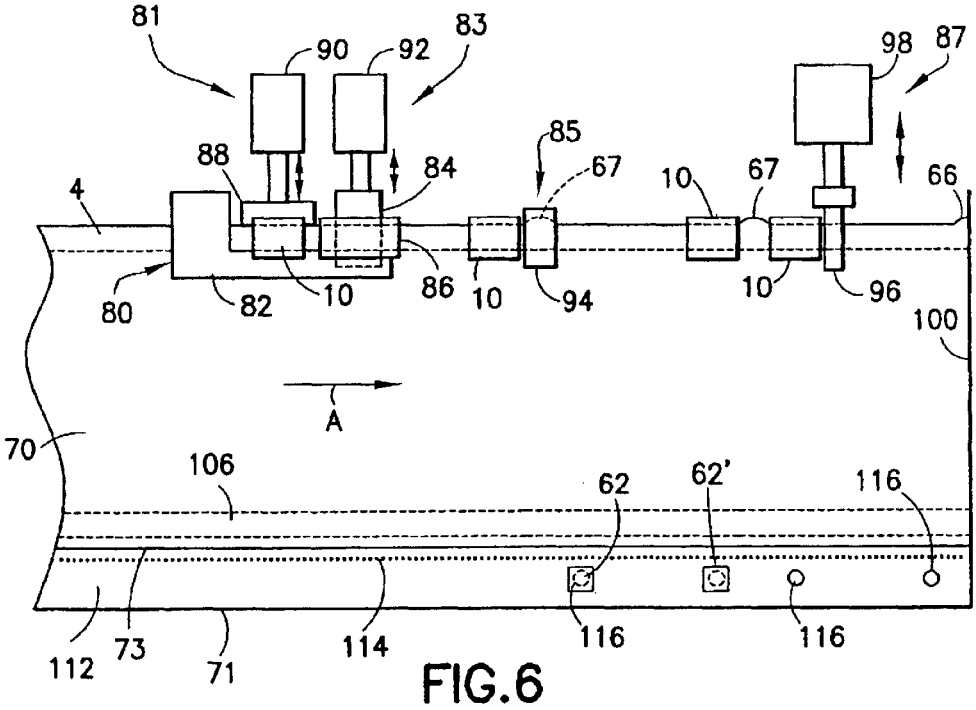
FIG.6

RECLOSABLE BAG HAVING WICKET FLAP AND SLIDER-ACTUATED STRING ZIPPER

RELATED PATENT APPLICATION

This application is a continuation-in-part of and claims priority from U.S. patent application Ser. No. 10/367,450 filed on Feb. 14, 2003 and entitled "Reclosable Packaging Having Slider-Operated String Zipper".

BACKGROUND OF THE INVENTION

This invention generally relates to reclosable bags having slideractuated plastic zippers. In particular, the invention relates to slider-actuated reclosable bags having a header or flap with holes or slits for mounting a stack of bags on a wicket.

Reclosable bags are finding evergrowing acceptance as primary packaging, particularly as packaging for foodstuffs such as cereal, fresh fruit and vegetables, cold cuts, snacks and the like. Such bags provide the consumer with the ability to readily store, in a closed, if not sealed, package any unused portion of the packaged product even after the package is initially opened.

Reclosable bags comprise a receptacle having a mouth with a plastic zipper for opening and closing. In recent years, many zippers have been designed to operate with a slider mounted thereon. As the slider is moved in an opening direction, the slider causes the zipper sections it passes over to open. Conversely, as the slider is moved in a closing direction, the slider causes the zipper sections it passes over to close. Typically, a zipper for a reclosable bag includes a pair of interlockable profiled closure strips that are joined at opposite ends of the bag mouth. The profiles of interlockable plastic zipper strips can take on various configurations, e.g. interlocking rib and groove elements having so-called male and female profiles, interlocking alternating hook-shaped closure elements, etc. Reclosable bags having slider-operated zippers are generally more desirable to consumers than bags having zippers without sliders because the slider eliminates the need for the consumer to align the interlockable zipper profiles before causing those profiles to engage.

Reclosable bags are commonly used by deli clerks in grocery stores to package cheese and deli meats sold to consumers. To facilitate handling of the reclosable bags by the deli clerks, the bags often include a header having one or more holes for mounting a stack of bags to one or more dispensing posts. The reclosable bags are typically mounted to the dispensing posts in bag packs consisting of a predetermined number of bags. The dispensing posts may, e.g., take the form of a U-shaped wicket wherein the legs of the U-shaped wicket penetrate respective holes formed in the header of each bag. The header may take the form of a top header extending upward from the zippered mouth of the bag or a bottom header extending downward from the bottom of the bag.

U.S. Pat. No. 5,682,730 discloses a plurality of plastic bags formed into convenient unitary packs for shipping and loading onto dispensing posts. This is done by stacking the bags and then assembling them into a unitary pack by penetrating the stack with a heated or ultrasonic pin or punch element to form apertures. The bags in the pack are heat-welded or ultrasonically welded together along the periphery of the apertures. To maintain the integrity of the bag pack during shipping, the bag is mounted to dispensing posts in the form of a wicket prior to shipment.

More specifically, U.S. Pat. No. 5,682,730 discloses a reclosable bag having a bottom header with two holes for mounting the plastic bag to a pair of dispensing posts. The holes are spaced apart along a lateral line running generally parallel to the zipper. The bottom header includes a line of perforations that allows the bag to be torn away from the header after the bag has been filled with product. The embodiment illustrated in U.S. Pat. No. 5,682,730 has a bottom header that includes a pair of opposing header panels connected by a fold. The fold forms a primary bottom, while a seal line of thermal fusion forms a secondary bottom at the junction of the receptacle and the header. This patent further states that one of the header panels can be eliminated.

The top of the bag U.S. Pat. No. 5,682,730 has a slider-actuated zipper. The zipper comprises two profiled zipper strips that have respective fins or flanges thermally fused to the inner surfaces of the receptacle panels.

An alternative to the flanged zipper design is the so-called flangeless or string zipper, which has no flange portion above or below the interlockable closure profiles. In the case of a string zipper, the bag making film is joined to the backs of the bases of the zipper strips. U.S. patent application Ser. No. 10/367,450 discloses a reclosable bag in which respective marginal portions of the bag film are sealed to the backs of respective flangeless zipper strips and in which the resulting string zipper is actuated by means of a slider. String zippers can be produced at much greater speeds, allow much greater footage to be wound on a spool, thereby requiring less set-up time, and use less material than flanged zippers, enabling a substantial reduction in the cost of manufacture and processing.

There is a continuing need for new designs for wicketed reclosable bags that can be manufactured at low cost.

BRIEF DESCRIPTION OF THE INVENTION

The present invention is directed to a reclosable bag having a bottom flap and a slider-actuated string zipper installed in a mouth at the top of the bag. The flap may be provided with one or more discontinuities that allow a stack of empty bags to be hung on one or more post and filled one by one. The invention is further directed to a method of manufacturing such bags.

One aspect of the invention is a reclosable bag comprising a receptacle, a slider-actuated string zipper at one end of the receptacle, and a flap extending from an opposite end of the receptacle in a direction away from the string zipper. The flap comprises at least one discontinuity.

Another aspect of the invention is a reclosable bag comprising: a receptacle comprising first and second walls comprising respective upper marginal portions that form a mouth at a top of the receptacle and respective lower portions that extend to a bottom of the receptacle; a string zipper comprising first and second mutually interlockable zipper strips respectively joined to the upper marginal portions of the first and second walls; a slider mounted on the string zipper for opening and closing the string zipper; and a flap extending from the bottom of the receptacle in a direction away from the string zipper.

A further aspect of the invention is a method of manufacturing a reclosable bag, comprising the following steps: (a) folding a web of bag making film so that a first portion of the web on one side of the fold has an extension portion that extends beyond an edge of a second portion of the folded web; (b) joining a back of a first flangeless zipper strip to one of the first and second web portions before or after the folding step; (c) joining a back of a second flangeless zipper strip to the other of the first and second web portions before or after the folding step; (d) joining confronting portions of the first and second web portions along a band-shaped zone extending generally parallel to and proximal to the edge of the second portion of the folded web; (e) removing the folded edge of the web; and (f) inserting a slider on the first and second flangeless zipper strips after the folded edge has been removed.

Another aspect of the invention is a reclosable bag comprising: first and second generally rectangular walls, each of the first and second walls having a top, a bottom and two sides, the first and second walls having the same width from side to side, but different heights from top to bottom, the tops of the first and second walls being generally aligned, while the second wall extends beyond the bottom of the first wall to form a flap, the first and second walls being joined together along a band-shaped zone proximal to the bottom of the first wall; first and second flangeless zipper strips having backs respectively joined to respective portions of the first and second walls that are proximal to their respective tops; and a slider mounted on the first and second flangeless zipper strips and movable in opposite directions for causing the first and second flangeless zipper strips to engage or disengage.

A further aspect of the invention is a method of manufacturing a reclosable bag, comprising the following steps: (a) arranging and sealing film material to form a receptacle and a flap connected to the receptacle, the receptacle having an interior volume and a mouth for accessing the interior volume, and the flap extending beyond a boundary of the receptacle located opposite to and distant from the mouth; (b) prior to completion of the receptacle, joining respective portions of the film material, that will form the mouth of the receptacle, to respective backs of first and second flangeless zipper strips; (c) aligning the first and second flangeless zipper strips with each other; and (d) after steps (b) and (c), mounting a slider onto the aligned first and second flangeless zipper strips with the respective portions of the film material being disposed between respective side walls of the slider and respective backs of the first and second flangeless zipper strips.

Other aspects of the invention are disclosed and claimed below.

BRIEF DESCRIPTION OF THE DRAWINGS

FIG. 5 is a drawing showing a top view of a continuous-movement section of an automated production line for manufacturing the bag depicted in FIG. 1. The zipper-film assembly shown in FIG. 5 is advanced from left to right, as indicated by arrow A.

FIG. 6 is a drawing showing a top view of an intermittent-movement section of the aforementioned production line, which section follows the continuous-movement section depicted in FIG. 5. The continuous movement in the section shown in FIG. 5 is converted to intermittent movement in the section shown in FIG. 6 by a conventional dancer assembly (not shown).

Reference will now be made to the drawings in which similar elements in different drawings bear the same reference numerals.

DETAILED DESCRIPTION OF THE INVENTION

Figure 1:
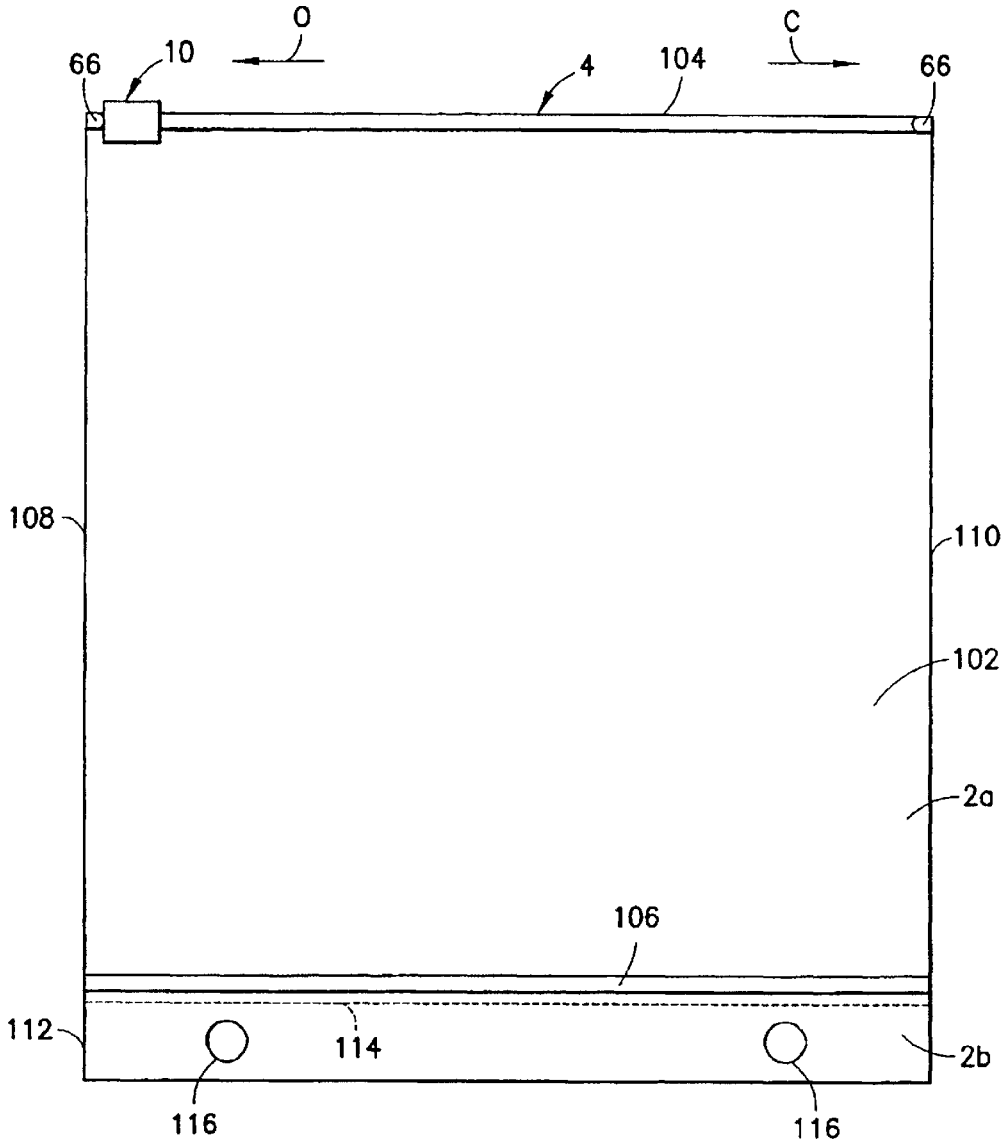
FIG. 1 is a drawing showing a front view of a reclosable package having a bottom header and a slider-operated string zipper in accordance with one embodiment of the present invention. For the purpose of this illustration, it has been assumed that the bag film is optically transparent, so that the string zipper is visible behind a layer of film.

A reclosable bag in accordance with one embodiment of the invention is shown in FIG. 1. The bag comprises a receptacle 102 having a top 104, a band seal 106 at the bottom, and left and right side seals 108, 110. The receptacle comprises a front wall 2*a* and a rear wall 2*b*, which can be seen in section in FIG. 2. Still referring to FIG. 1, the front and rear walls are joined by the band seal 106, which extends across the full width of the receptacle. The bag further comprises a string zipper 4 installed in the mouth at the top of the receptacle and a slider 10 mounted on the string zipper 4 for opening and closing the mouth of the bag. The string zipper 4 and the band seal 106 are generally mutually parallel.

The string zipper 4 is operated by sliding the slider 10 along the zipper strips. As the slider 10 moves across the zipper 4, the zipper is opened or closed. As shown in FIG. 1, the slider 10 is slidable along the zipper 4 in a closing direction "C", causing the zipper strips to become engaged, or in an opening direction "O", causing the zipper strips to become disengaged.

Referring again to FIG. 1, the string zipper 4 further comprises end stops 66 for preventing the slider 10 from sliding off the end of the zipper when the slider reaches the zipper closed or fully opened position. Typically, the end stops are formed by fusing the ends of the zipper strips together while at the same time shaping the fused material into an end stop structure. Such end stops perform dual functions, serving as stops to prevent the slider from going off the end of the zipper and also holding the two zipper profiles together to prevent the bag from opening in response to stresses applied to the profiles through normal use of the bag. However, the present invention is not limited to the incorporation of a slider end stop structure of any particular type.

Still referring to FIG. 1, each of the front and rear wall is generally rectangular. The front and rear walls have the same width from side to side, but different heights from top to bottom. The top edges of the front and rear walls 2*a* and 2*b* are generally aligned, while the rear wall 2*b* extends beyond the bottom edge of the front wall 2*a*, as shown in FIG. 1, to form a generally rectangular flap 112. The flap 112 extends from the bottom of the receptacle 102 in a direction away from the string zipper 4. The flap 112 has a width equal to the width of the receptacle 102.

The flap has a line 114 of weakened tear resistance that extends substantially along the entire length of the flap 112 in parallel with and spaced apart from the band seal 106. The line 114 of weakened tear resistance may comprise a line of spaced perforations, a scoreline, or any other functionally equivalent structure. In accordance with some embodiments of the invention, the flap 112 is integrally formed with either the front or rear wall of the receptacle 102. However, the bag shown in FIG. 1 could also be manufactured by forming the flap as a separate panel that is joined to the web of bag making film, as will be described in more detail later.

The flap also has a pair of circular holes 116 which are spaced apart along a line running generally parallel to the line 114 of weakened tear resistance. These holes 116 can be penetrated by a pair of posts of the type shown in FIG. 3 of U.S. Pat. No. 5,682,730. The radius of the hole is greater than the radius of the post. Multiple bags can be mounted to the dispensing posts to form a stack, with the holes in the flaps 112 being aligned by the posts. Slits can be used instead of holes.

Bags of the type depicted in FIG. 1 can be manufactured on a machine. The method of manufacture in accordance with one embodiment of the invention comprises the following steps: (a) folding a web of bag making film so that a first portion of the web on one side of the fold has an extension portion that extends beyond an edge of a second portion of the folded web; (b) joining a back of a first flangeless zipper strip to one of the first and second web portions before or after the folding step; (c) joining a back of a second flangeless zipper strip to the other of the first and second web portions before or after the folding step; (d) joining confronting portions of the first and second web portions along a band-shaped zone extending generally parallel to and proximal to the edge of the second portion of the folded web; (e) removing the folded edge of the web; and (f inserting a slider on the first and second flangeless zipper strips after the folded edge has been removed. FIG. 3 shows the folded edge of the web of film with a string zipper 4 joined to the web on opposing sides of the fold 76. The film will be cut along lines 54 and 56 to trim away the folded edge of the web, leaving respective walls 2*a* and 2*b*. The slider is then mounted to the trimmed structure, as seen in FIG. 2.

At the end of the production line, when each finished bag comes off the machine, it is carried and placed over a pair of posts. Successive bags are so placed until a predetermined number of bags have been stacked on the posts. The posts are then moved and replaced by another set of posts having no bags stacked thereon. The completed stack from the moved set of posts are lifted manually or automatically off of the posts. Then the parallel legs of a U-shaped wicket made of wire are passed through the aligned holes of the stacked bags. The stack of bags is secured on the wicket and then placed inside a box for shipment, e.g., to a grocery store. In use, the bags are filled with product manually. Then the open top of the bag is closed by manipulation of the slider. Finally, the filled bag is removed from the stack by tearing the bag along the line of weakened tear resistance, thereby severing the filled receptacle from the flap that remains mounted to the wicket.

Alternatively, the bags can be sealed to each other by ultrasonic pins during the process of forming holes for dispensing posts.

Figure 2:
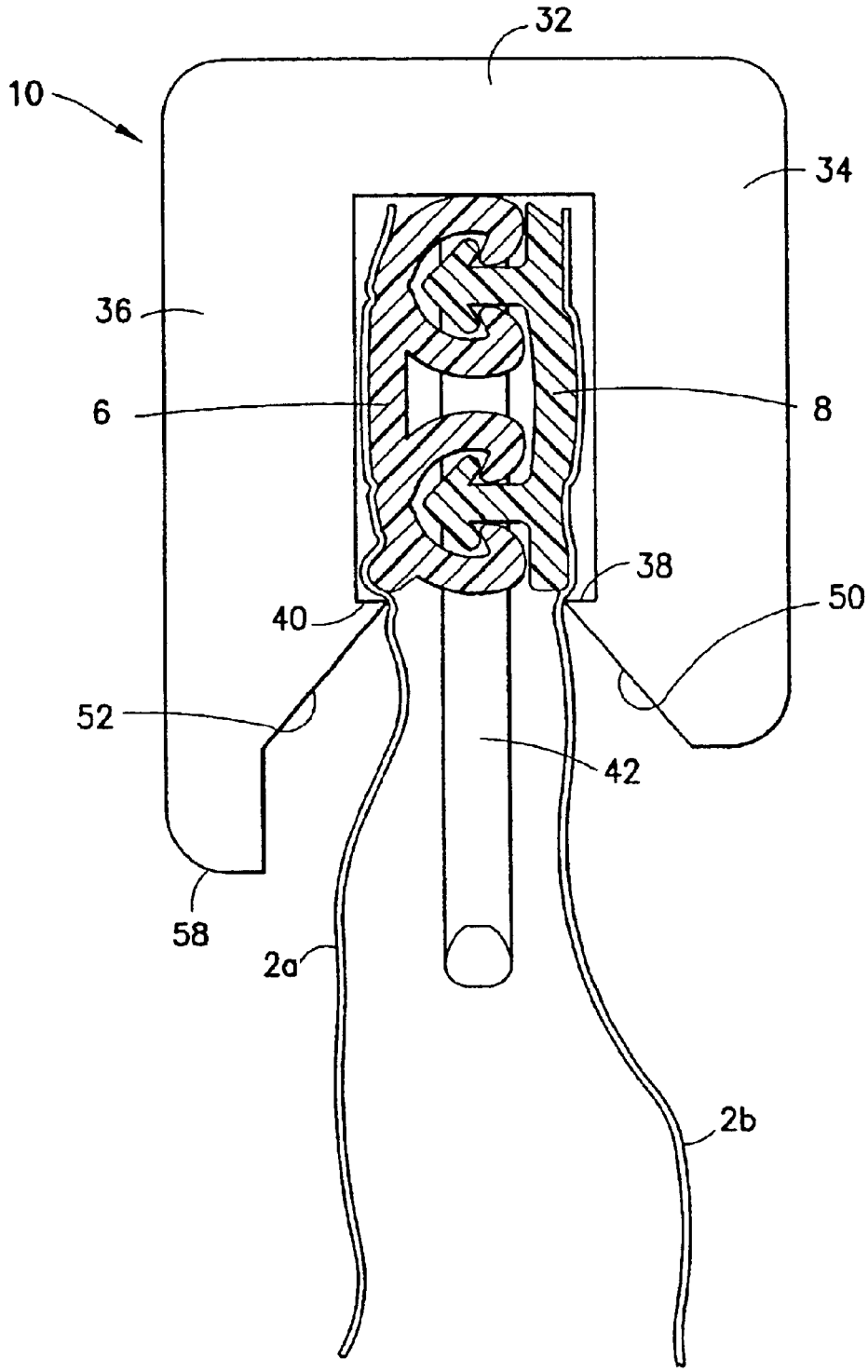
FIG. 2 is a drawing showing a sectional view of a slider-string zipper assembly [previously disclosed in U.S. patent application Ser. No. 10/367,450] that can be incorporated in the bag depicted in FIG. 1. The zipper is shown sectioned in a plane in front of the closing end of the slider.
Figure 3:
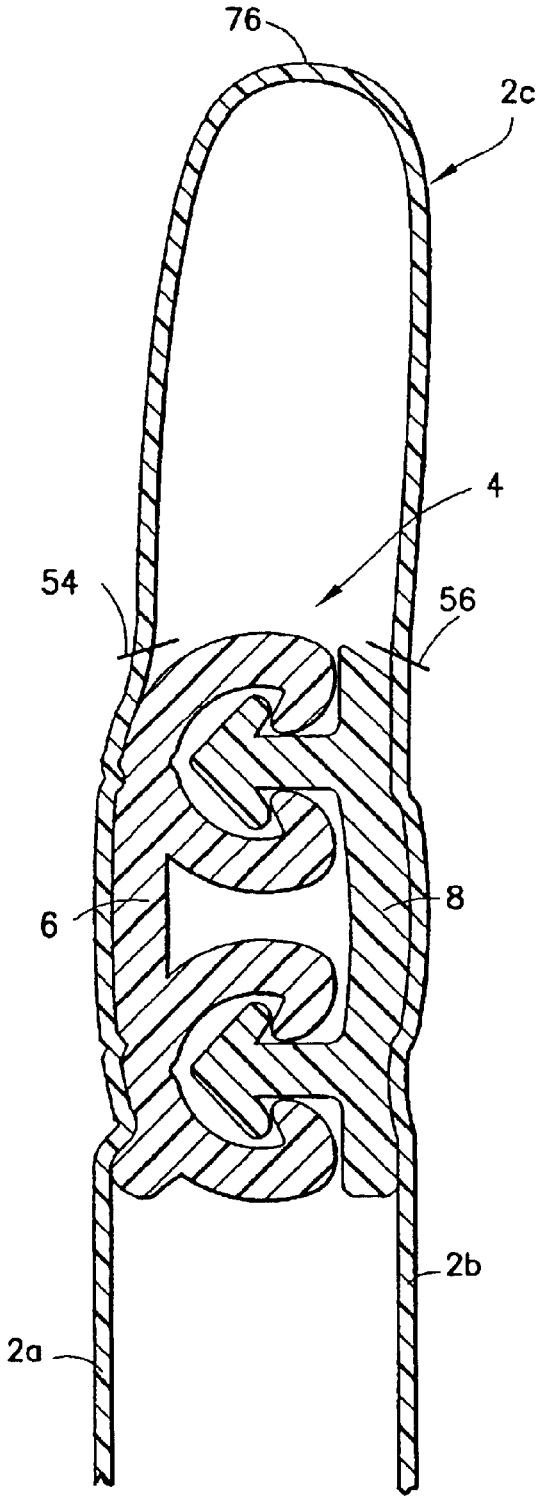
FIG. 3 is a drawing showing a sectional view of the folded edge of the precursor structure comprising a folded web of film with a string zipper installed in the fold.

The trimmed structure at the top of the bag is shown in section in FIG. 2. The extruded plastic string zipper comprises a pair of interlockable zipper parts or strips 6 and 8. Although FIG. 2 shows a rib and groove arrangement, the profiles of the zipper strips may take any form. For example, the string zipper may comprise interlocking rib and groove elements (as shown in FIG. 2) or alternating hook-shaped closure elements. The preferred zipper material is polyethylene or polypropylene. The upper marginal portions of the front and rear bag walls 2*a* and 2*b* (see FIG. 2) are respectively sealed to the backs of the zipper strips 6 and 8 by a conventional conduction heat sealing technique.

To open the closed zipper, the zipper strips 6 and 8 are pushed apart with sufficient force by the slider plow (item 42 in FIG. 2) to pry the heads of the male members out of the female profiles. When the shoulders of the male members clear the hooks of the outwardly flexed gripper jaws, the male and female members are no longer interlocked and the zipper is open.

Figure 4:
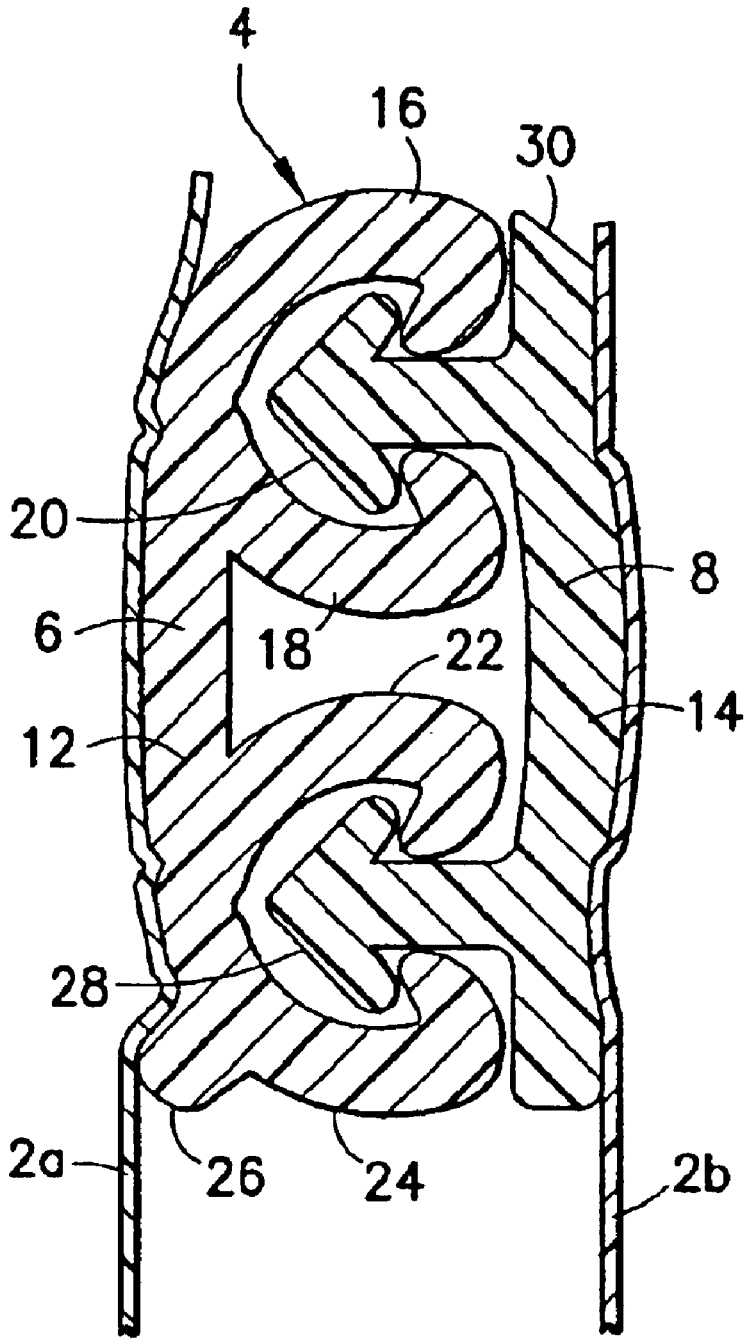
FIG. 4 is a drawing showing a sectional view of the string zipper-film assembly after the folded edge of film has been trimmed off.

The string zipper is shown on a larger scale in FIG. 4. [Only portions of the trimmed film are shown in FIG. 4.] Again the numerals 2*a* and 2*b* indicate the opposing walls (made, e.g., of plastic film) of the receptacle. The walls 2*a* and 2*b* of the receptacle are joined to the zipper strips 6 and 8 respectively, e.g., by heat sealing. The zipper in this example is an extruded plastic structure comprising mutually interlockable profiled zipper strips 6 and 8. Zipper strip 8 comprises a base and two generally arrow-shaped rib-like male closure elements or members 20 and 28 projecting from a base 14, while zipper strip 6 comprises two pairs of hook-shaped gripper jaws connected by a sealing bridge 12. The pairs of gripper jaws form respective complementary female profiles for receiving the male profiles of closure elements 20 and 28. More specifically, jaws 16 and 18 receive and interlock with the male element 20, while jaws 22 and 24 receive and interlock with the male element 28. Alternatively, one zipper strip could have one male profile and one female profile, while the other zipper strip has one female profile and one male profile, or the respective zipper strips could each have more than two male or female profiles.

Still referring to FIG. 4, the sealing bridge 12 and the base 14 are resiliently flexible self-supporting structures having a thickness greater than the thickness of the bag film. The male closure elements are integrally formed with the base 14, while the female closure elements are integrally formed with the sealing bridge 12. The upper margins of the walls 2*a* and 2*b* of the bag are joined to the backs of the sealing bridge 12 and the base 14 respectively. The upper margins of the bag film may have short free ends that extend beyond the termination points depicted in FIG. 4, provided that the free ends are not so long as to interfere with travel of the slider along the zipper or become entangled with the zipper profiles.

The end face of upper edge 30 of the base 14 that carries the male closure elements 20 and 28 is inclined at about a 45° angle to facilitate loading of the slider onto the zipper from above without snagging on a corner of the upper edge. The bottom edge of the base 14 cooperates with a retaining ledge on the slider to increase the slider pull-off resistance. For the same purpose, a rib 26 is formed on zipper strip 6, the rib 26 cooperating with a retaining ledge on the other side of the slider.

Numerous configurations for the interlockable male and female members are known in the art. The present invention is not limited to use with male members having an arrow-shaped head. Male members having expanded heads with other shapes may be used. For example, instead of an expanded head having a pointed tip, the front face of the expanded head may be rounded. In other words, the head could have a semicircular profile instead of a triangular profile. Alternatively, the expanded head of the male member could have a trapezoidal profile. In addition, although FIGS. 2 and 3 show a rib-and-groove arrangement, the profiles of the zipper strips may take any form. For example, either string zipper may comprise alternating hook-shaped closure elements.

Nor is the invention limited to having two female profiles on one zipper strip and two male profiles on the other zipper strip. In the first place, the string zipper could have one complementary set of male and female profiles, or it could have more than two complementary sets of male and female profiles. Furthermore, in the case of two complementary sets of male and female profiles, one zipper strip could have one male profile and one female profile, while the other zipper strip has one female profile and one male profile. Other variations should be apparent to persons skilled in the art of resealable packaging.

The slider 10 shown in FIG. 2 is more fully disclosed in U.S. patent application Ser. No. 10/367,450. The slider 10 comprises a top wall 32, a pair of side walls 34 and 36 connected to opposing sides of the top wall 32, the top wall 32 and side walls 34, 36 forming a tunnel for passage of the string zipper therethrough. The ends of the slider are open to allow the zipper to pass through. The width of the tunnel is substantially constant along the section that is divided by the plow and then narrows from a point proximal to the end of the plow to the closing window at one end face of the slider. The narrowing section of the tunnel is formed by a pair of substantially planar, inclined interior surfaces (not visible in FIG. 2), which converge toward the closing window of the slider. The inclined surfaces funnel or squeeze the zipper strips toward each other, causing the zipper profiles to interlock, as the slider is moved in the closing direction. The side walls 34 and 36 are formed with concave curved indentations where the user may place the tips of an index finger and a thumb for gripping the slider. Alternatively, convexities (e.g., ribs) could be formed on the sides of the slider to facilitate grasping.

The slider 10 also comprises a plow or divider 42 that depends downward from a central portion of the top wall 32 to an elevation below the lowermost portions of each side wall. The plow partitions the tunnel inside the slider and is disposed between opposing sections of the zipper strips that pass through the tunnel. The tip of the plow 42 is truncated and has rounded edges and flattened corners at opposing ends for facilitating insertion of the plow between the zipper profiles without snagging.

The plow 42 comprises a beam having a cross-sectional shape that is a rectangle with rounded corners. The axis of the beam is generally perpendicular to the top wall of the slider. As the slider is moved in the opening direction (i.e., with the closing end leading), the plow 42 pries the impinging sections of zipper strips 6 and 8 apart. The plow 42 divides the opening end of the slider tunnel into respective passages for the separated zipper strips to pass through.

As partly seen in FIG. 3, the slider 10 further comprises a retaining projection or ledge 38 that projects inward from the side wall 34 and a retaining projection or ledge 40 that projects inward from the side wall 36. The ledges 38 and 40 project toward each other, forming respective latches for latching the slider onto the zipper. The ledges 38 and 40 have substantially coplanar, generally horizontal upper surfaces on which the bottom edges of the zipper profiles can sit, thereby effectively latching the slider under the bottom edges of the zipper strips to increase slider pull-off resistance. For improved gripping, the upper surfaces of the retaining ledges may be angled upward toward the distal edge.

The ledges 38 and 40 further comprise respective inclined bottom surfaces 50 and 52 that extend downward and outward from the respective inner edges of the generally horizontal surfaces. The inclined surfaces 50 and 52 are each substantially planar, with the respective planes of these inclined surfaces intersecting at a line inside the tunnel that is generally parallel to the longitudinal axis of the slider. The inclined surfaces 50 and 52 serve to guide the respective zipper strips 6 and 8 into the slider tunnel during insertion of the slider onto the zipper. The sliders are typically inserted at spaced intervals onto a zipper-film assembly that is being intermittently advanced in a machine direction by automated slider insertion equipment.

The generally horizontal surfaces of the retaining ledges latch under the zipper profiles and assist in retaining the slider on the zipper, while the inclined bottom surfaces of the retaining ledges assist in slider insertion onto the zipper by guiding or funneling the respective zipper strips into the slider passageway, including the passages on opposing sides of the plow.

The slider may be made in multiple parts and welded together or the parts may be constructed to be snapped together. The slider may also be of one-piece construction. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS. To reduce the cost of manufacture, the slider may be designed to reduce the amount of material used and to increase the speed with which such sliders can be injection molded. Suitable injection-molded slider designs are fully disclosed in U.S. patent application Ser. No. 10/412,438.

Reclosable packages of the type depicted in FIG. 1 can be manufactured on an automatic production line. An exemplary production line is shown in FIGS. 5 and 6. FIG. 5 shows a section of the production line in which the zipper strips and bag making film move continuously. FIG. 6 shows a further section in which the zipper strips and bag making film move intermittently. The continuous movement in the section shown in FIG. 5 is converted to intermittent movement in the section shown in FIG. 6 by a conventional dancer assembly (not shown). However, a person skilled in the art will readily appreciate that the bag making film could be moved intermittently in all stages of the production line, in which case a dancer assembly can be eliminated.

The operations performed continuously during continuous advancement include: folding a web of film so that one side of the web extends beyond the other side of the web; introducing zipper strips at an angle and sealing them to confronting web portions a short distance from the fold; band sealing confronting web portions along the margin adjacent the bottom edge of the short side of the folded web; trimming excess film at the top of the zipper strips, thereby removing the fold; and forming a line of perforations in the flap (i.e., the extended portion of the long side of the folded web) at a point beyond the bottom edge of the short side of the folded web.

The operations performed during dwell times in the intermittent-movement section include: inserting sliders on the zipper; forming slider end stops at spaced intervals along the zipper; forming pairs of holes in the flap at spaced intervals, as seen in FIG. 1; and cutting the zipper-film assembly with a hot knife that both seals and severs to form a separate package. Other operations are performed during intermittent advancement of the zipper-film assembly. For example, during each advancement, a new section of zipper is pried open by a stationary separator assembly at a point upstream of the slider insertion zone. In addition, downstream of the slider insertion zone, a previously inserted slider is held stationary while the zipper-film assembly moves relative thereto, such relative movement of the slider closing a corresponding section of the string zipper. Optionally, the zipper could be left open.

The transition from continuous advancement of the film to intermittent advancement of the film is accomplished by a conventional dancer assembly (not shown in FIGS. 5 and 6).

Referring to FIG. 5, numeral 70 designates a web of bag making film that has been folded, while the dashed lines bounding a strip designated by the numeral 4 represent a string zipper installed between the confronting sides of the folded web. The fold is indicated by numeral 76 in FIG. 5. Instead of folding the web along a centerline, the fold is located off-center, the result being that one side of the folded web is longer than the other. The shorter side of the folded web is designated 2*a* in FIG. 1; the longer side is designated 2*b* in FIG. 1 and will ultimately form the wicket flap (item 112 in FIGS. 1 and 5). The web of film 70 advances continuously in the direction indicated by arrow A in FIG. 5.

The web of film is unwound from a roll (not shown), passed over a conventional folding board or plow (not shown) and then pulled through the bag making machine by means of conventional guide and drive rollers (not shown). A string zipper 4, comprising a pair of interlocked flangeless zipper strips, is unwound from a reel (not shown) and fed between the opposing portions of the folded web 70. At a zipper sealing station, these opposing portions of the web are joined to the backs of the zipper strips by a conventional band sealer comprising a pair of mutually opposing conventional heated sealing bars 74 (only one of which is visible in FIG. 5). The result of the zipper sealing operation can be seen in FIG. 3.

As the folded web 70 with inserted zipper 4 advances continuously between the opposing sets of sealing bars 74, the respective backs of the interlocked zipper strips are sealed to the opposing portions of the web 70, thereby continuously attaching incoming sections of the moving string zipper to adjoining sections of the moving web. The sealing is accomplished by electrically heating the sealing bars, the heat being conducted through respective endless belts (not shown) made of Teflon or similar material, which circulate on respective sets of rollers (not shown). In the gap between the opposing sealing bars 74, the web and string zipper are sandwiched between and held together by the Teflon belts, which move with the web and string zipper and prevent the bag making film from sticking against the stationary heated sealing bars during conduction heat sealing.

In FIG. 5, the bottom edge of the long side of the web 70 is designated by numeral 71, while the bottom edge of the short side of the web 70 is designated by numeral 73. In accordance with one embodiment of the method for manufacturing the bag shown in FIG. 1, confronting portions of the moving web 70 in a band-shaped zone proximal to the bottom edge 73 of the short side of the web are continuously heat sealed by another conventional band sealer of the type described above, comprising a pair of heated sealing bars 75, only one of which is seen in FIG. 5. This band seal (item 106 in FIG. 1) will later constitute the closed bottom of each receptacle.

Immediately downstream from the sealing stations, the folded edge of the web 70 above the string zipper 4 is cut by a pair of stationary knives 78 (only one of which is visible in FIG. 5). More specifically, each knife cuts a substantial portion of the film that extends beyond the zone of film-to-zipper strip joinder to the fold 76, thereby removing the folded edge of the web. The untrimmed folded edge 2*c* is depicted in FIG. 3, with the cutting lines being indicated by numerals 54 and 56. The cutting lines 54 and 56 should be placed close enough to the respective zipper strips 6 and 8 so that the remnants of film projecting above the zipper are not long enough to interfere with operation of the slider (shown in FIG. 2) as it moves along the zipper.

Referring once again to FIG. 5, a line of spaced perforations 114 is formed in the flap 112 by a perforator 60. Other means for forming a line of weakness could also be used. The perforator 60 may be a reciprocating device mounted at a fixed station. As the zipper-film assembly advances in the machine direction, the reciprocating device will form spaced perforations in the moving flap along a line slightly below the edge 73 of the short side of the folded web.

The band-sealed and trimmed zipper-film assembly then wends its way through a conventional dancer assembly (not shown in either FIG. 5 or FIG. 6) on its way to the machinery depicted in FIG. 6. The dancer assembly converts the upstream continuous advancement of the film into downstream intermittent advancement of the film. In the intermittent advancement phase, the zipper-film assembly is moved one package increment and then stopped for a period of time, i.e., the dwell time. This cycle is repeated.

Referring now to FIG. 6, a slider 10 is inserted onto the zipper-film assembly at a slider insertion station. The slider insertion station comprises three assemblies (to wit, a separator assembly 80, a pusher assembly 81 and a clamping assembly 83) that cooperate to insert the slider 10 on the zipper 4 while the zipper is being held open on both sides of the zipper portion on which the slider is inserted.

Upstream of the slider insertion zone, a separator assembly 80 disengages the zipper strips while the zipper-film assembly is advanced one package length. The separator assembly comprises a central splitter plate separated by gaps from upper and lower guides disposed above and below the splitter plate. Only the upper guide 82 of the separator assembly is visible in FIG. 6. The upper and lower guides hold the respective zipper strips in respective grooves formed in the splitter plate (not shown). Thus, as the zipper-film assembly is pulled through the bag making machine, the splitter plate will pry open successive package-length sections of zipper during successive zipper-film advancements.

In the slider insertion zone, the pusher assembly 81 comprises a pusher 88 that pushes a slider 10 onto the zipper 4. The pusher is extended by actuation of an air cylinder 90. When the pusher 88 is retracted, the next slider must be automatically fed to a pre-insertion position directly in front of the pusher. This is accomplished by a conventional pneumatic slider feeding system (not shown). The upper and lower guides of the separator assembly 80 comprise respective blades that extend in cantilevered fashion into the slider insertion zone, as taught in U.S. patent application Ser. No. 10/436,433 entitled "Method and Apparatus for Inserting Sliders During Automated Manufacture of Reclosable Bags". These blades are disposed to brace the respective zipper strips against deflection as the slider 10 is pushed onto the zipper 4.

Downstream of the slider insertion zone, the zipper 4 is clamped by a clamping assembly 83 comprising a retractable separator plate 84 that is interposed between the zipper strips of the open zipper section, and upper and lower zipper clamps that clamp the zipper strips against the extended separator plate 84. Only the upper zipper clamp 86 is visible in FIG. 6. The separator plate 84 is extended by actuation of an air cylinder 92. Following extension of the separator plate 84, the upper and lower zipper clamps are extended by actuation of respective air cylinders that are not shown in FIG. 8.

Thus, the upper and lower guides of the separator assembly 80, and the upper and lower zipper clamps of the clamping assembly 83 serve to stabilize the zipper during slider insertion. The interposition of the splitter plate (not shown) and the separator plate 84 between the zipper strips upstream and downstream, respectively, of the slider insertion zone means that the zipper is maintained in an open state, with a gap between the zipper strips, in the zone where the slider is inserted. The zipper strips are held in respective positions such that the slider plow 42 (see FIG. 2) enters the gap between the zipper strips and then the slider side walls respectively pass over and latch under the zipper strips during slider insertion.

During the same dwell time that a slider is being inserted, a slider end stop structure 67 is being formed on the zipper at an ultrasonic stomping station downstream from the slider insertion device. This slider end stop structure 67 will be bisected later during cutting by a hot knife 100 to form two slider end stops 66, i.e., the end stop at the zipper fully closed slider park position for one package and the end stop at the zipper fully open slider park position for the next package. The end stop structure 67 is formed by an ultrasonic stomping assembly 85 comprising a horn 94 and an anvil (not shown in FIG. 6). The horn 94 transmits sufficient ultrasound wave energy into that plastic zipper material that the plastic is fused into a structure (e.g., a vertically extending hump) defined by the surfaces of the horn and anvil. The horn and anvil may be of the reciprocating or rotary variety.

During each dwell time, other ultrasonic apparatus can be used to form a pair of holes 116 in that portion (i.e., flap 112) of the long side of the web that extends beyond the edge 73 of the short side of the web. For example, a pair of ultrasonic horns 62 and 62' are designed to form respective circular holes in each flap 112. The cooperating anvils of the ultrasonic apparatus are not shown in FIG. 6. Alternatively, holes or slits could be made using suitably shaped cutters.

After each dwell time, the entire slider-zipper-film assembly is advanced. During each intermittent advancement, a slider stopper assembly 87 restrains a slider 10 so that a moving section of zipper 4 is closed. The slider stopper assembly 87 comprises a stopper element 96 coupled to an air cylinder 98. The stopper element 96 is movable from a retracted position to an extended position by actuation of the air cylinder 98. The stopper element 96 is in its extended position when the advancement of the zipper-film assembly begins. In this extended position, the stopper element 96 interferes with the slider and blocks it from advancing with the moving zipper. This causes a displacement of the slider 10 relative to the zipper 4 in a zipper closing direction, thereby closing a section of zipper. Before the advancement of one package length is completed, the stopper element 96 is retracted, which allows the slider to advance past the retracted stopper element.

During each dwell time, a hot cutting knife 100 (which may comprise a solitary blade or a pair of opposed blades) cuts and forms side seals in the film on both sides of the cut, thereby severing a bag (not shown in FIG. 6) from the remainder of the web 70 on the bag making machine. Each bag is then placed on a pair of posts by aligning the holes in the wicket flap with the posts and then inserting the posts into the holes by moving the bag. Each successive bag takes its place atop the stack of bags mounted to the posts until a predetermined maximum number of bags is achieved. Then the stack is removed from the posts and a wicket is inserted in the removed stack. This can be done manually or automatically.

In accordance with an alternative embodiment of the automated production line disclosed above, the web of film material and the string zipper could be moved intermittently through the section depicted in FIG. 5. In this case a respective length of string zipper would be sealed to the film (e.g., by reciprocating sealing bars) during each dwell time, with the string zipper and film being advanced an equal length during. each interval between successive dwell times. The cutting and perforating operations would be performed during advancement of the film.

A reclosable bag having the structure depicted in FIG. 1 can be manufactured using methods other than those described with reference to FIGS. 5 and 6. For example, instead of folding the web of film and then inserting and joining string zipper material between opposing web portions, one side of the string zipper material could be joined to the film, the film is then folded, and thereafter the other side of the string zipper is joined to a confronting portion of the folded web. Alternatively, respective flangeless zipper strips could be joined in parallel to an unfolded web, the web is then folded along a centerline, and the zipper strips are interlocked after folding.

Instead of starting with a single web that is folded, one could begin with two webs that will be sealed on three sides to form each receptacle. The use of two webs would again entail the three variations of: (1) placing the string zipper between the webs and sealing the sides of the zipper to the respective webs; (2) sealing one side of the string zipper to one web, placing the other web in opposing relationship, and then sealing the other side of the string zipper to the other web; and (3) sealing one flangeless zipper strip to one web, sealing the other flangeless zipper strip to the other web, and then interlocking the zipper strips while attached to the respective webs.

In accordance with yet another variation, one could fold a web of film, join a string zipper to opposing marginal portions of the web on the end opposite the fold, and then seal together the opposing web portions adjacent the folded edge, thereby forming a merged double layer of film that will serve as the bottom header panel or flap of the reclosable bag. Discontinuities (e.g., a pair of spaced holes) and a line of weakened tear resistance (e.g., a line of spaced perforations) are then formed in the double-layer flap. Alternatively, the layers of the folded end can be band-sealed together at a distance from the fold, the band seal forming the bottom of the receptacle and the double-layer flap being open at both ends.

The invention does not require that the slider have a plow or separating finger. The slider-zipper assembly could be designed so that the side walls of a straddling slider cam or push the zipper open, without the aid of a plow or separating finger, when the slider is moved in an opening direction.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc. As used in the claims, the term "string zipper" means a zipper comprising two interlockable closure strips that have substantially no flange portions.

We claim:

1. A method of manufacturing a reclosable bag, comprising the following steps:

(a) folding a web of bag making material so that a first portion of said web on one side of said fold has an extension portion that extends beyond an edge of a second portion of said folded web;

(b) joining a back of a first flangeless zipper strip to one of said first and second web portions before or after said folding step;

(c) joining a back of a second flangeless zipper strip to the other of said first and second web portions before or after said folding step;

(d) joining confronting portions of said first and second web portions along a band-shaped zone extending generally parallel to and proximal to said edge of said second portion of said folded web;

(e) removing the folded edge of said web after steps (a), (b) and (c) have been performed; and (f) inserting a slider on said first and second flangeless zipper strips after steps (a), (b), (c) and (e) have been removed, whereby a portion of said first web portion that is joined to said back of said first flangeless zipper strip is disposed between said first flangeless zipper strip and a first side wall of said slider, and a portion of said second web portion that is joined to said back of said second flangeless zipper strip is disposed between said second flangeless zipper strip and a second side wall of said slider.

2. The method as recited in claim 1, wherein said removing step comprises cutting respective portions of said first and second web portions adjacent said first and second flangeless zipper strips respectively.

3. The method as recited in claim 1, further comprising the step of forming first and second discontinuities in said extension portion of said web before or after said folding step.

4. The method as recited in claim 3, wherein said discontinuities are holes.

5. The method as recited in claim 3, wherein said discontinuities are slits.

6. The method as recited in claim 1, wherein step (a) is performed after step (b) and before step (c), further comprising the step of interlocking said first and second flangeless zipper strips prior to step (b).

7. The method as recited in claim 1, wherein steps (b) and (c) are performed after step (a), further comprising the step of interlocking said first and second flangeless zipper strips and inserting said interlocked first and second flangeless zipper strips between said first and second web portions prior to steps (b) and (c).

8. The method as recited in claim 1, wherein steps (b) and (c) are performed before step (a), further comprising the step of interlocking said first and second flangeless zipper strips after step (a).

9. A method of manufacturing a reclosable bag, comprising the following steps:

(a) arranging and sealing bag making material to form a receptacle and a flap connected to said receptacle, said receptacle having an interior volume and a mouth for accessing said interior volume, and said flap extending beyond a boundary of said receptacle located opposite to and distant from said mouth;

(b) prior to completion of said receptacle, joining respective portions of said bag making material, that will form said mouth of said receptacle, to respective backs of first and second flangeless zipper strips;

(c) aligning said first and second flangeless zipper strips with each other; and (d) after steps (b) and (c), mounting a slider onto said aligned first and second flangeless zipper strips with said respective portions of said bag making material passing between respective side walls of said slider and respective backs of said first and second flangeless zipper strips.

10. The method as recited in claim 9, wherein step (a) comprises the following steps:

folding a web of bag making material along a fold line to form a U- or V-shaped profile comprising first and second legs;

joining respective portions of said first and second legs of said web to form said receptacle, other respective portions of said first and second legs forming said respective opposing portions joined to said first and second flangeless zipper zipper strips.

11. The method as recited in claim 10, wherein said first and second legs are band-sealed together along a line parallel to and spaced apart from said fold line.

12. The method as recited in claim 10, wherein said second leg is longer than said first leg, said flap comprising a portion of said second leg that extends beyond an edge of said first leg.

13. The method as recited in claim 10, further comprising the step of trimming respective portions of said first and second legs connected by said fold line.

14. The method as recited in claim 10, further comprising the step of forming at least one discontinuity in said flap.

15. The method as recited in claim 10, further comprising the step of forming a line of weakened tear resistance in said flap.

* * * * *